US010993021B2

(12) United States Patent
Song et al.

(10) Patent No.: US 10,993,021 B2
(45) Date of Patent: Apr. 27, 2021

(54) SPEAKER MODULE

(71) Applicant: AAC Technologies Pte. Ltd., Singapore (SG)

(72) Inventors: Wei Song, Shenzhen (CN); Fan Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/702,574

(22) Filed: Dec. 4, 2019

(65) Prior Publication Data

US 2020/0213714 A1 Jul. 2, 2020

(30) Foreign Application Priority Data

Dec. 27, 2018 (CN) ..... 201811619056.X

(51) Int. Cl.
*H04R 1/28* (2006.01)
*H04R 1/02* (2006.01)

(52) U.S. Cl.
CPC ..... *H04R 1/288* (2013.01); *H04R 1/025* (2013.01)

(58) Field of Classification Search
CPC ..... H04R 1/288; H40R 1/025
USPC ..... 381/354
See application file for complete search history.

(56) References Cited

U.S. PATENT DOCUMENTS

| | | | | |
|---|---|---|---|---|
| 9,838,765 | B1 * | 12/2017 | Li | H04R 1/288 |
| 9,918,161 | B1 * | 3/2018 | Chen | H04R 1/2873 |
| 2007/0147645 | A1 * | 6/2007 | Kuze | H04R 1/2819 381/337 |
| 2007/0286449 | A1 * | 12/2007 | Matsumura | H04R 1/2803 381/433 |
| 2008/0149418 | A1 * | 6/2008 | Imamura | H04R 1/288 181/199 |
| 2016/0127822 | A1 * | 5/2016 | Zhang | H04R 1/288 381/346 |
| 2017/0164096 | A1 * | 6/2017 | Herold | H04R 1/2853 |
| 2017/0303033 | A1 * | 10/2017 | Shao | H04R 9/06 |

* cited by examiner

*Primary Examiner* — Sean H Nguyen
(74) *Attorney, Agent, or Firm* — W&G Law Group LLP

(57) ABSTRACT

The present application provides a speaker module, and the speaker module includes a housing having a receiving space and a speaker unit mounted in the receiving space. The speaker unit divides the receiving space into a front cavity and a rear cavity opposite to the front cavity. The speaker module further includes a sound absorbing cover received in the rear cavity and fixedly connected to the housing. A connecting surface of the housing to be connected to the sound absorbing cover is provided with a recess facing towards the sound absorbing cover. The recess is in communication with the rear cavity, and a surface of the sound absorbing cover facing towards the recess is an air-permeable surface. Compared with the related art, the speaker module provided by the present disclosure has better acoustic performance.

8 Claims, 6 Drawing Sheets

SPEAKER MODULE

TECHNICAL FIELD

The present disclosure relates to the technical field of electroacoustic conversion, and in particular, to a speaker module.

BACKGROUND

In recent years, information technology has developed rapidly, especially wireless mobile communication technology. More and more mobile electronic devices are applied in people's daily lives, such as smart phones, tablets, laptops and multi-functional media players, and they have become must-have items in people's lives. A speaker module as a voice playing device becomes a core component of the above mobile electronic device, and its performance directly affects the performance of the entire device.

The speaker module known in the related art includes a housing having a receiving space, a speaker unit and a sound absorbing cover that are mounted in the receiving space. By providing a sound absorbing cover, an acoustic performance of the speaker module is greatly enhanced due to absorbing particle materials provided in the sound absorbing cover.

However, when the sound absorbing cover is mounted on the speaker module known in the related art, the sound absorbing cover is often directly connected to the housing, so that a side surface of the sound absorbing cover, connected to the housing, is not air-permeable, which in turn results in a loss of the acoustic performance of the speaker module.

Therefore, it is urgent to provide a new speaker module to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Figure 1:
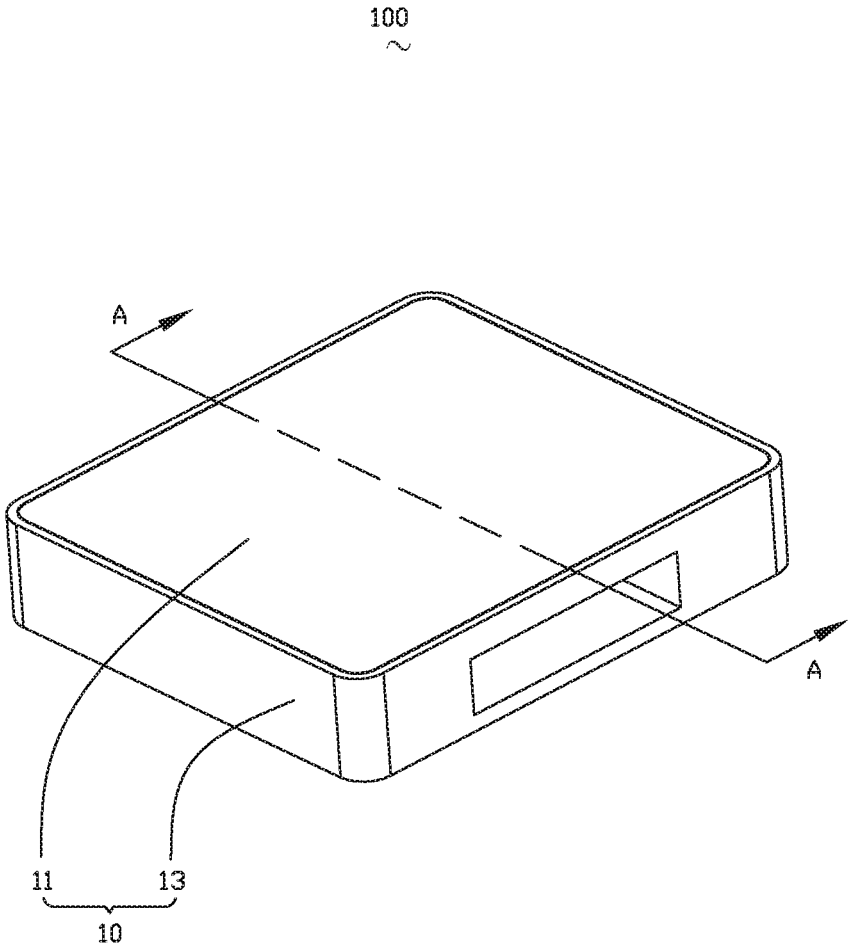
FIG. 1 is a perspective structural schematic diagram of a speaker module provided by the present disclosure.
Figure 2:
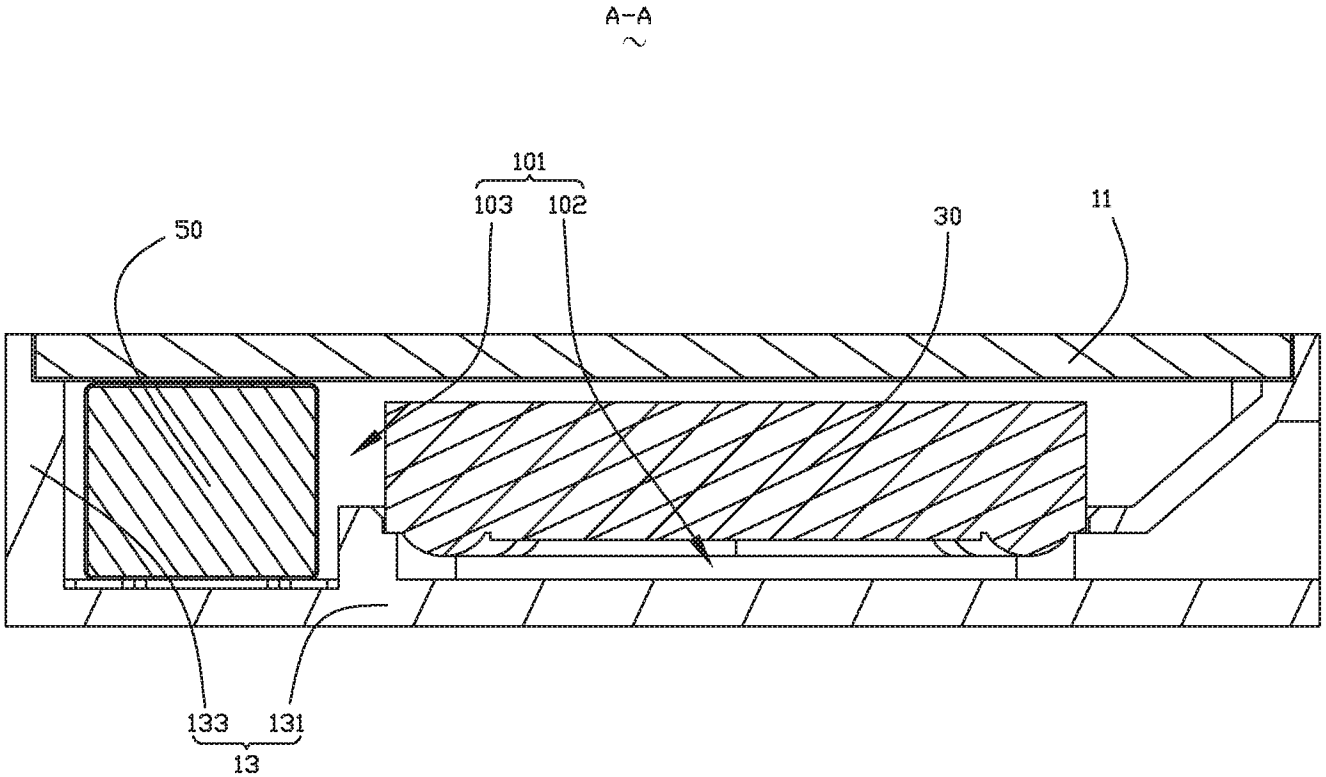
FIG. 2 is a cross-sectional view of the speaker module taken along line A-A shown in FIG. 1.
Figure 3:
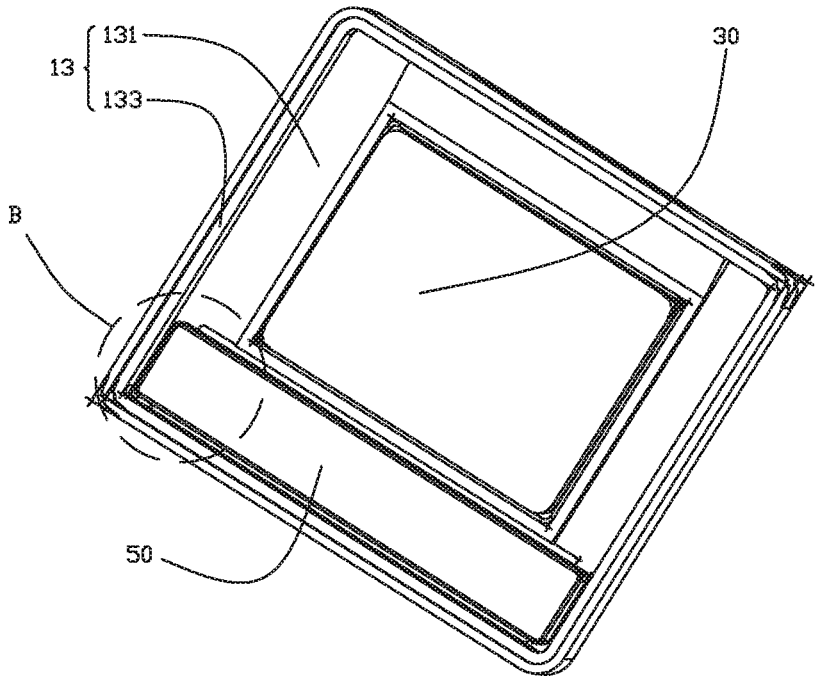
FIG. 3 is a perspective structural schematic diagram of the speaker module shown in FIG. 1, when an upper cover is removed.
Figure 4:
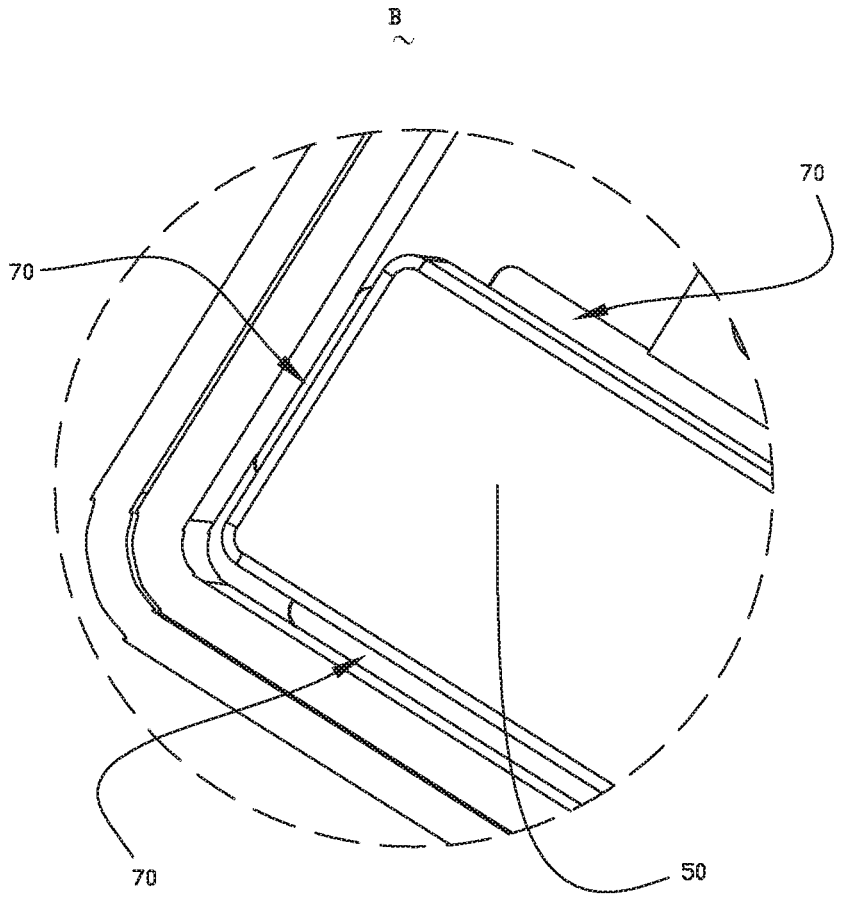
FIG. 4 is an enlarged view of a portion B of the speaker module shown in FIG. 3.
Figure 5:
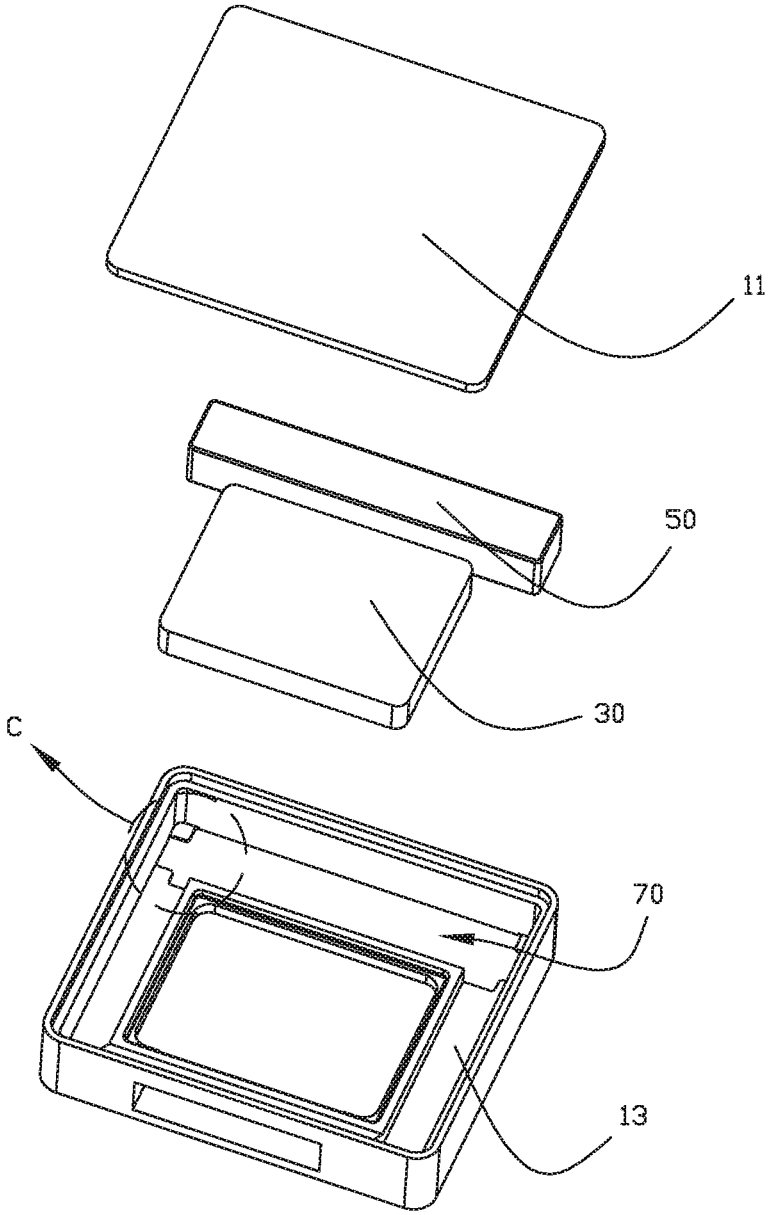
FIG. 5 is an exploded structural view of the speaker module shown in FIG. 1.
Figure 6:
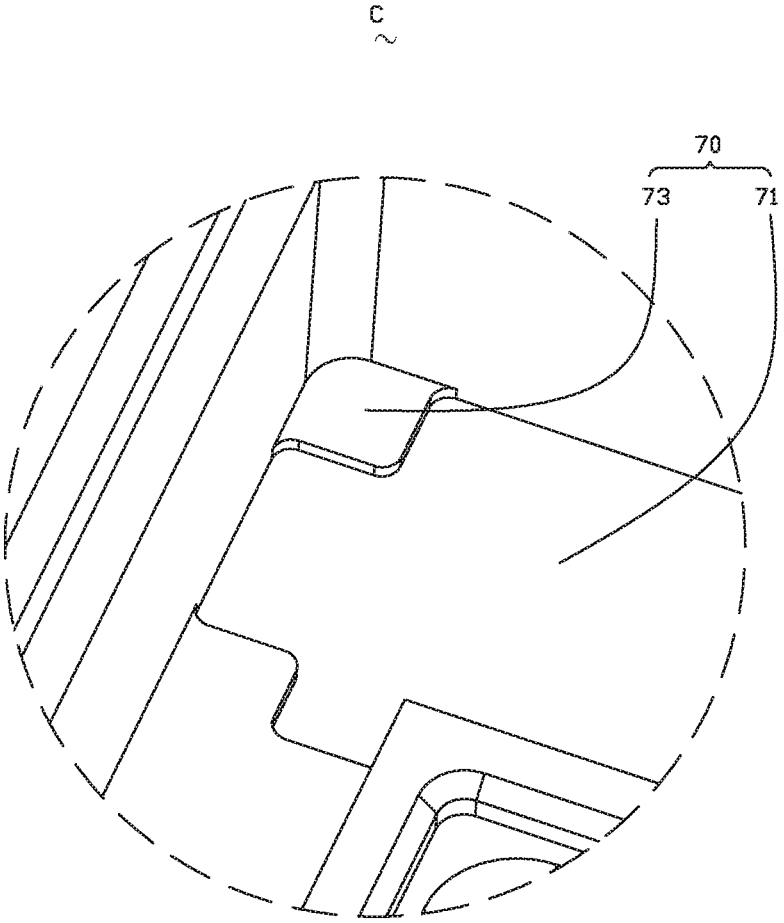
FIG. 6 is an enlarged view of a portion C of the speaker module shown in FIG. 5.

Referring to FIG. 1 to FIG. 6, the present disclosure provides a speaker module 100. The speaker module 100 includes a housing 10 having a receiving space 101, a speaker unit 30 and a sound absorbing cover 50 that are mounted in the receiving space 101. The speaker unit 30 divides the receiving space 101 into a front cavity 102, and a rear cavity 103 opposite to the front cavity 102. The sound absorbing cover 50 is received in the rear cavity 103 and fixedly connected to the housing 10.

The housing 10 includes an upper cover 11, and a base 13 assembled with the upper cover 11 to define the receiving space. A connecting surface of the housing 10, which is connected to the sound absorbing cover 50, is provided with a recess 70 facing towards the sound absorbing cover 50. The recess 70 is in communication with the rear cavity 103. A surface of the sound absorbing cover 50 facing towards the recess 70 is an air-permeable surface.

It should be noted that, when the recess 70 is ensured to be in communication with the rear cavity 103, the sound absorbing cover 50 can be fixedly connected to the upper cover 11 or the base 13. That is, the recess 70 can be disposed on the upper cover 11 or the base 13. In the present embodiment, as an example, the recess 70 is provided on the base 13, and the sound absorbing cover 50 is fixedly connected to the base.

For example, the base 13 includes a bottom wall 131 opposite to the upper cover 11, and four sidewalls 133 connecting the upper cover 11 with the bottom wall 131. The recess 70 is formed by recessing from a surface of the bottom wall 131 close to the upper cover 11 in a direction facing away from the upper cover 11.

The recess 70 has a rectangular shape. For example, the recess 70 includes a recess bottom 71, and four bosses 73 extending at corners of the recess bottom 71 towards the upper cover 11. The sound absorbing cover 50 is fixedly connected to the four bosses 73.

Since the sound absorbing cover 50 is fixedly connected to the bosses 73, the sound absorbing cover 50 is spaced apart from the recess bottom 71 to define a receiving space. Further, an orthographic projection of the sound absorbing cover 50 on the upper cover 11 falls within an orthographic projection of the recess 70 on the upper cover 11. With such a configuration, the receiving space and the rear cavity 103 are ensured to be in communication with each other, such that sound can penetrate through the surface of the sound absorbing cover 50 connected to the housing 10, thereby intensifying the communication between the sound absorbing cover 50 and the speaker unit 30, and improving the acoustic performance of the speaker module 100.

In the present embodiment, for example, a surface of the boss 73 facing away from the recess bottom 71 and a surface of the bottom wall 131 close to the upper cover 11 are in the same plane.

For example, the sound absorbing cover 50 is glued to the bosses 73.

Further, in the present embodiment, surfaces of the sound absorbing cover 50 facing towards the four sidewalls 133 are all spaced apart from the sidewalls 133, and the surfaces of the sound absorbing cover 50 facing towards the sidewalls 133 are all air-permeable. With such a configuration as well as the surfaces of the sound absorbing cover 50 facing towards the bottom walls 131, the sound absorbing cover 50 has a five air-permeable surfaces structure, which further intensifying the communication between the sound absorbing cover 50 and the speaker unit 30 and improving the acoustic performance of the speaker module 100.

For example, the surface of the sound absorbing cover 50 facing towards the upper cover 11 is also an air-permeable surface, and spaced apart from the upper cover 11. With such a configuration, the sound absorbing cover 50 has a six air-permeable surfaces structure such that the sound generated by the speaker unit 30 can be transmitted to the sound absorbing cover 50 through each surface of the sound absorbing cover 50, thereby improving the acoustic performance of the speaker module 100 to the maximum extent.

For example, the sound absorbing cover 50 is formed by hot pressing. The sound absorbing cover 50 is filled with sound absorbing material to enhance the sound absorbing effect of the sound absorbing cover 50.

Compared with the related art, in the speaker module 100 of the present disclosure, the recess 70 facing towards the sound absorbing cover 50 and communicating with the rear cavity 103 is on the connecting surface of the housing 10 connected to the sound absorbing cover 50, and the surface of the sound absorbing cover 50 facing towards the recess 70 is the air-permeable surface, such that the sound can penetrate through the surface where the sound absorbing cover 50 is connected to the housing 10, thereby enhancing the communication between the sound absorbing cover 50 and the speaker unit 30 and improving the acoustic performance of the speaker module 100; and other surfaces of the sound absorbing cover 50, which face towards the sidewalls 133 and the upper cover 11, are all configured to be air-permeable surfaces to form the six air-permeable surfaces structure of the sound absorbing cover 50, which greatly enhances the air permeability of the sound absorbing cover 50 and improves the acoustic performance of the speaker module 100.

The above described embodiments are merely intended to illustrate the present disclosure, and it should be noted that, without departing from the inventive concept of the present disclosure, the improvements made by those skilled in the related art shall fall within the protection scope of the present disclosure.

What is claimed is:

1. A speaker module, comprising:

a housing having a receiving space;

a speaker unit mounted in the receiving space, the speaker unit dividing the receiving space into a front cavity and a rear cavity opposite to the front cavity; and a sound absorbing cover received in the rear cavity and fixedly connected to the housing, wherein a connecting surface of the housing connected to the sound absorbing cover is provided with a recess facing towards the sound absorbing cover, the recess is in communication with the rear cavity, and a surface of the sound absorbing cover facing towards the recess is an air-permeable surface, the housing comprises an upper cover and a base assembled with the upper cover to define the receiving space, the recess is provided on the base, the base comprises a bottom wall facing towards the upper cover, and the recess is formed by recessing from a surface of the bottom wall close to the upper cover in a direction facing away from the upper cover.

2. The speaker module as described in claim 1, wherein the recess has a rectangular shape, the recess comprises a recess bottom and four bosses extending at corners of the recess bottom towards the upper cover, and the sound absorbing cover is fixedly connected to the four bosses.

3. The speaker module as described in claim 2, wherein a surface of each of the four bosses facing away from the recess bottom is in a same plane as the surface of the bottom wall close to the upper cover, and an orthographic projection of the sound absorbing cover on the upper cover falls within an orthographic projection of the recess on the upper cover.

4. The speaker module as described in claim 2, wherein the sound absorbing cover is glued to the four bosses.

5. The speaker module as described in claim 1, wherein the base further comprises four sidewalls connecting the bottom wall with the upper cover, and surfaces of the sound absorbing cover facing towards the four sidewalls are respectively spaced apart from the four sidewalls and are all air-permeable surfaces.

6. The speaker module as described in claim 5, wherein a surface of the sound absorbing cover facing towards the upper cover is an air-permeable surface and spaced apart from the upper cover.

7. The speaker module as described in claim 1, wherein the sound absorbing cover is filled with a sound absorbing material.

8. The speaker module as described in claim 1, wherein the sound absorbing cover is formed by hot pressing.

* * * * *